US007509943B2

(12) United States Patent
Ricco et al.

(10) Patent No.: US 7,509,943 B2
(45) Date of Patent: Mar. 31, 2009

(54) INJECTION SYSTEM FOR AN INTERNAL-COMBUSTION ENGINE

(75) Inventors: Mario Ricco, Valenzano (IT); Sisto Luigi De Matthaeis, Valenzano (IT); Annunziata Anna Satriano, Valenzano (IT); Onofrio De Michele, Valenzano (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 0 days.

(21) Appl. No.: 11/937,625

(22) Filed: Nov. 9, 2007

(65) Prior Publication Data

US 2008/0066719 A1 Mar. 20, 2008

Related U.S. Application Data

(62) Division of application No. 11/097,123, filed on Apr. 4, 2005, now Pat. No. 7,305,968.

(30) Foreign Application Priority Data

Jun. 30, 2004 (EP) ..... 04425473

(51) Int. Cl.
*F02M 55/02* (2006.01)
*F02M 63/02* (2006.01)

(52) U.S. Cl. ..... 123/456; 123/468; 123/477

(58) Field of Classification Search ..... 123/446, 123/447, 456, 467, 468, 449, 470, 514
See application file for complete search history.

(56) References Cited

U.S. PATENT DOCUMENTS

| | | | | |
|---|---|---|---|---|
| 4,709,679 | A * | 12/1987 | Djordjevic et al. | 123/447 |
| 5,433,182 | A | 7/1995 | Augustin et al. | |
| 5,642,714 | A * | 7/1997 | Buckley | 123/447 |
| 5,727,525 | A * | 3/1998 | Tsuzuki | 123/447 |
| 6,142,127 | A | 11/2000 | Maass | |
| 6,360,722 | B1 | 3/2002 | Onishi | |
| 6,832,599 | B2 | 12/2004 | Ibrahim et al. | |
| 7,047,942 | B2 | 5/2006 | Ando et al. | |
| 2002/0124834 | A1 | 9/2002 | Rembold et al. | |

FOREIGN PATENT DOCUMENTS

| | | |
|---|---|---|
| DE | 102 10 282 A1 | 9/2003 |
| EP | 0 959 245 A2 | 11/1999 |
| EP | 1 013 921 A2 | 6/2000 |
| EP | 1 361 357 A2 | 11/2003 |
| JP | 07054731 | 2/1995 |

* cited by examiner

*Primary Examiner*—Stephen K Cronin
*Assistant Examiner*—Arnold Castro
(74) *Attorney, Agent, or Firm*—Berenato, White & Stavish

(57) ABSTRACT

A fuel-injection system (1, 1', 1") for an internal-combustion engine (2), of the type provided with compressor mechanism (4) for making available the fuel at a high pressure to an storage volume (7), and a plurality of injectors (8, 8") fluidically connected to the storage volume (7) for taking in the fuel from the storage volume (7) and injecting it into respective combustion chambers (12) of the engine (2). The compressor mechanism (4) advantageously generates at least two distinct delivery lines (14), which are connected to respective distinct fractions (16) of the storage volume (7).

13 Claims, 6 Drawing Sheets

INJECTION SYSTEM FOR AN INTERNAL-COMBUSTION ENGINE

This is a Division Application of U.S. Patent Application No. 11/097,123 filed on Apr. 4, 2005 now U.S. Pat. No. 7,305,968.The disclosure of the prior application is hereby incorporated by reference herein in its entirety.

BACKGROUND OF THE INVENTION a) Filed of the Invention

The present invention relates to a fuel-injection system for an internal-combustion engine.

b) Background of the Related Art

Known, in the framework of compression-ignition engines for motor vehicles, are injection systems (the so-called common-rail systems) consisting of by a plurality of electro-injectors supplied by a common storage volume of fuel under pressure.

In particular, operation of said injection systems envisages that a low-pressure priming pump will draw the fuel from a tank and will make it available to a high-pressure pump. The high-pressure pump compresses the fuel up to the pressure of injection and makes it available to a common storage volume, which supplies the electro-injectors. A pressure-regulation system enables the desired pressure to be maintained within the storage volume.

The pump may be of the type with one or more pumping elements with reciprocating motion that generate a single delivery line, which feeds the common storage volume. Each pumping element performs each time a suction stroke and a compression or delivery stroke.

One of the functions of the common storage volume is that of dampening the pressure oscillations caused by the delivery of fuel from the high-pressure pump to the storage volume and by the extraction of fuel caused by opening of the electro-injectors.

In detail, the electro-injectors are supplied by the common storage volume and inject the fuel nebulized at high pressure into each of the combustion chambers of the respective engine cylinders.

With reference to the current state of the art, there is felt the need to reduce the volume of the common storage volume in order to meet more satisfactorily current standards on pollutant emission.

In greater detail, in the engine-starting stage, the high-pressure pump is driven by the engine of the motor vehicle, and hence there occurs a transient period, during which the common storage volume is at a pressure lower than the steady-state pressure, and the electro-injectors take in fuel to start the engine itself. The duration of this transient increases as the size of the common storage volume increases. The injection of fuel by the electro-injectors during this transient causes non-optimal operation of the internal-combustion engine and in particular increases the emission of pollutant substances.

Furthermore, the reduction in volume of the common storage volume would enable reduced overall dimensions and a more convenient installation in the internal-combustion engine.

However, the reduction in volume of the storage volume could entail drawbacks in the use of the injection system during steady running conditions. In particular, opening of the electro-injectors causes a pressure drop in the common storage volume. Said pressure drops are dampened by the storage volume in a way that is the more effective the greater the volume of the storage volume itself. Consequently, in the case where the volume of the storage volume were insufficient to dampen the aforesaid pressure drops, operation of the electro-injectors would be faulty, and the pollutant emissions of the internal-combustion engine would increase.

SUMMARY OF THE INVENTION

The purpose of the present invention is to provide an injection system for an internal-combustion engine which will enable the aforementioned requirements to be met in a simple and economically advantageous way. The aforesaid purpose is achieved by the present invention, in so far as it relates to an injection system for an internal-combustion engine having a compressor mechanism for making fuel available at a high pressure to an storage volume; and at least two injectors fluidically connected to the storage volume for taking in the fuel at a high pressure from the storage volume and injecting it into respective combustion chambers of the engine. The system being characterised in that the compressor mechanism generates at least two distinct delivery lines which supply respective distinct fractions of said storage volume.

BRIEF DESCRIPTION OF THE DRAWINGS

For a better understanding of the present invention, described in what follows are three preferred embodiments, which are provided purely by way of non-limiting examples and with reference to the attached plate of drawings, in which.

DETAILED DESCRIPTION OF THE PREFERRED EMBODIMENT

Figure 1:
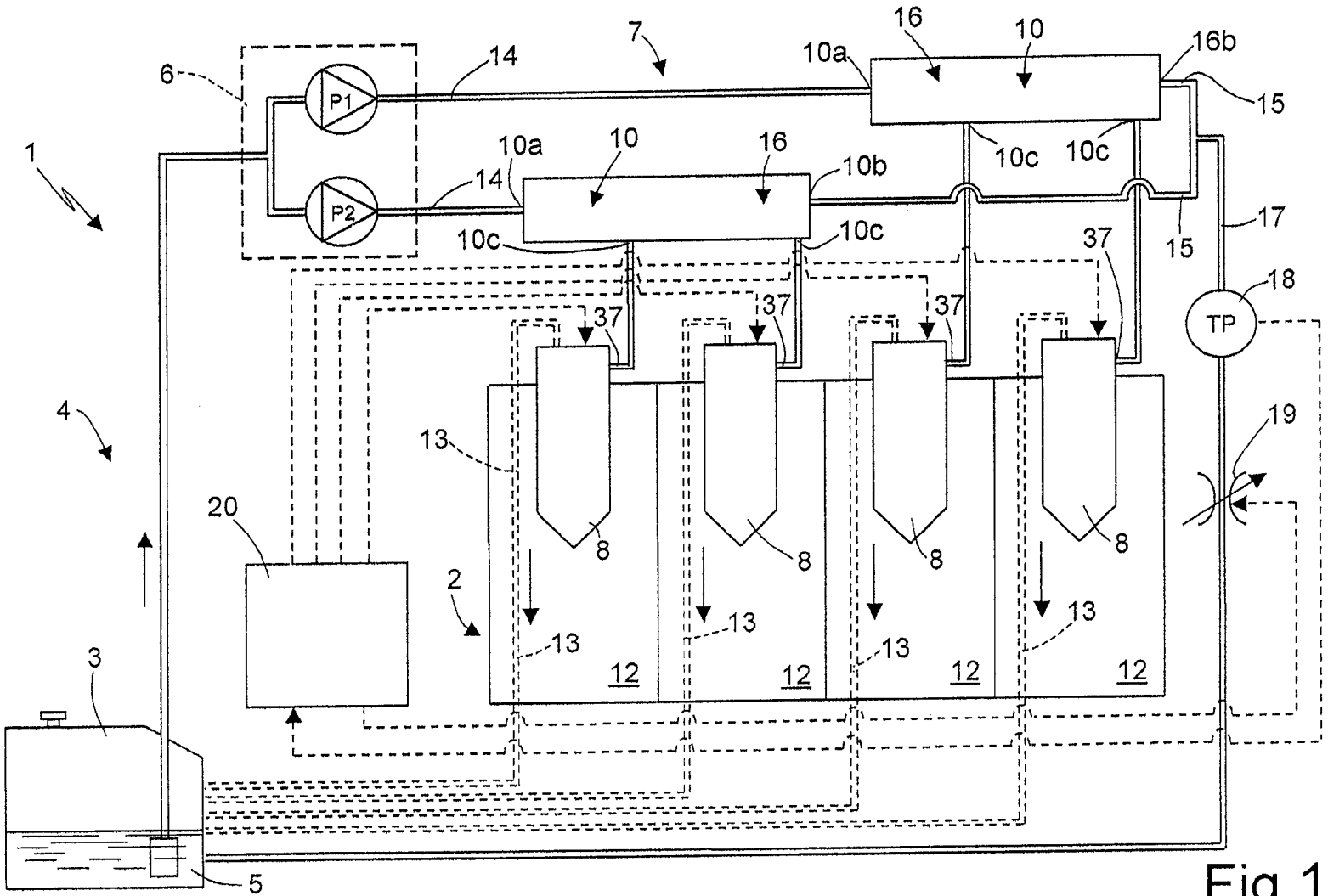
FIG. 1 is a diagram of an injection system for an internal-combustion engine made according to the teachings of the present invention.

With particular reference to FIG. 1, designated as a whole by 1 is an injection system for an internal-combustion engine 2, in itself known and illustrated only partially.

The system 1 basically comprises: a tank 3 for the fuel; a compressor assembly 4 for making available the fuel at a high pressure to an storage volume 7; a plurality of electro-injectors 8 fluidically connected to the storage volume 7 for taking in the fuel at a high pressure from the storage volume 7 itself and injecting it into respective combustion chambers 12 of the engine 2; and a pressure regulator 19 for correcting the value of the injection pressure with respect to the operating conditions of the engine 2, i.e., for adjusting the pressure of the fuel inside the storage volume 7 given the same pressure of the fuel delivered by the compressor assembly 4 to the storage volume 7 itself.

In the case in point illustrated, the compressor assembly 4 comprises a low-pressure pump 5 immersed in the fuel contained in the tank 3, and a high-pressure pump 6, which supplies the storage volume 7 directly and, hence, the electro-injectors 8.

The injection system 1 further comprises a control unit 20 for regulating, through an appropriate system of a type in itself known, the delivery pressure of the high-pressure pump 6 and opening of the electro-injectors 8. More in particular, the control unit 20, on the basis of the operating conditions imposed on the internal-combustion engine 2, determines the delivery pressure of the pump 6 and the time interval of injection of the fuel.

As may be seen in FIG. 1, the pump 6 is of the known type with a number of pumping elements with reciprocating motion. In the case in point illustrated they number two and are designated, respectively, by P1 and P2. Each of said pumping elements is formed by a cylinder (known and not illustrated) having a compression chamber in which a corresponding piston slides.

According to an important aspect of the present invention, the high-pressure pump 6 generates a plurality of distinct delivery lines 14, in the case in point illustrated two, each of which extends from a corresponding pumping element P1, P2 and supplies a respective distinct fraction 16 of the storage volume 7.

Furthermore, respective fuel-outlet lines 15 depart from each fraction 16 of the storage volume 7. In particular, the outlet lines 15 are connected downstream of the fractions 16 and are connected, via a fuel-return line 17, to the tank 3.

In greater detail, each fraction 16 of the storage volume 7 is enclosed in a corresponding first tubular body 10, which has, at one end, a first opening 10*a* for intake of the fuel through the corresponding delivery line 14 and, at the opposite end, a second opening 10*b* to enable outlet of the fuel through the corresponding line 15. Furthermore, in an intermediate position, each fraction 16 has a plurality of openings, in the case in point illustrated two, each of which feeds the fuel into the respective electro-injector 8, described in detail in what follows.

The pressure regulator 19 consists of a solenoid valve with variable section for passage of fluid set along the line 17 and is controlled in a known way by the control unit 20 for varying the amount of fuel present in the storage volume 7 and, hence, the injection pressure Advantageously, the pressure regulator 19 is set on the line 17 downstream of the global storage volume 7 so as to enable a continuous flow of the fuel through the storage volume 7 itself even in conditions of absence of injection and, consequently, so as to limit the pressure oscillations that are created following upon each injection into the corresponding electro-injector 8 in order to bring such electro-injector back again into the pressure conditions required for the subsequent injection.

As may be seen in FIG. 1, the pressure regulator 19 is associated in a known way to a pressure transducer 18, which is designed to supply the control unit 20 with the pressure values detected along the fuel-return line 17 and is set upstream of the pressure regulator 19 itself.

Figure 4:
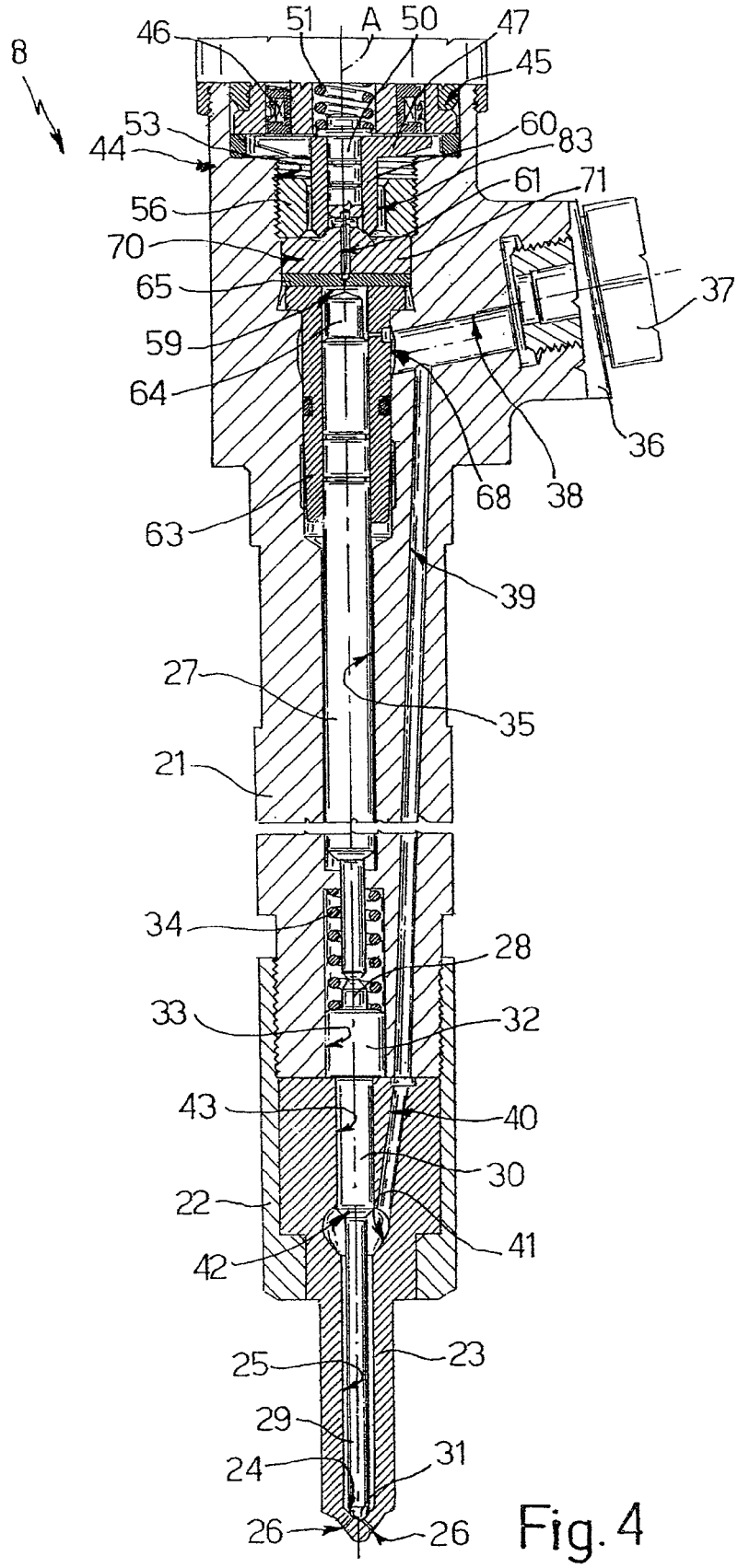
FIG. 4 is a cross-sectional view, at an enlarged scale, of an injector of the injection system of FIG. 1.
Figure 5:
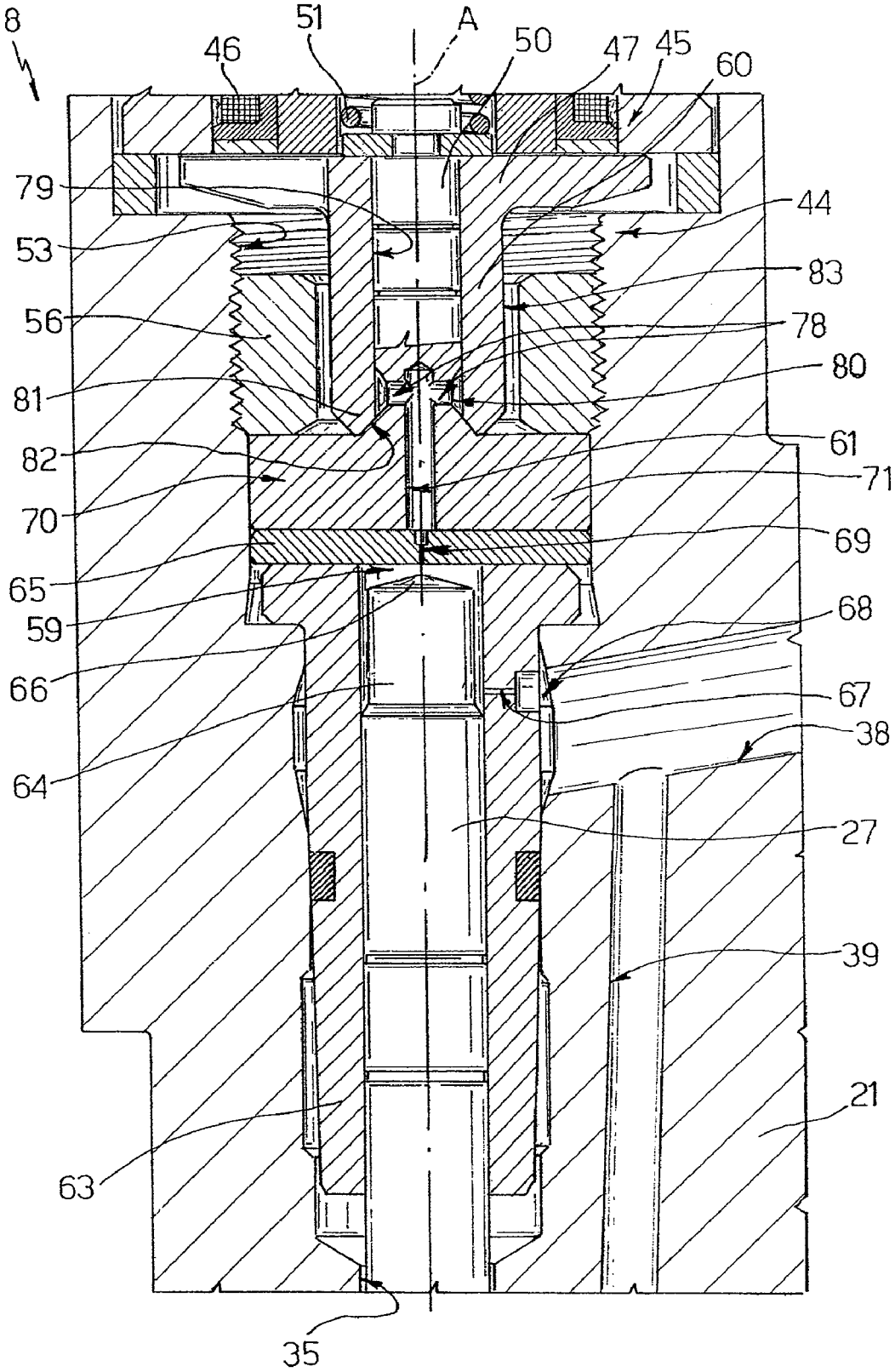
FIG. 5 illustrates, at a further enlarged scale, a detail of the injector of FIG. 4.

With particular reference to FIGS. 4 and 5, each electro-injector 8 has an axis A and comprises a hollow body 21 coupled, via a ring-nut 22, to a nozzle 23. The nozzle 23 is provided with an axial hole 25 and terminates with a conical seat 24, arranged in which is a plurality of injection holes 26 communicating with the respective combustion chamber 12 of the engine 2. The body 21 is provided with an axial hole 35, in which a rod 27 for controlling injection of the fuel through the nozzle 23 is able to slide.

The hollow body 21 moreover has a side appendage 36, inserted in which is a connector 37 defining a fuel-inlet mouth connected to the corresponding opening 10*c* (see FIG. 1) of the body 10, which encloses a respective fraction 16 of the storage volume 7. The appendage 36 has a hole 38 in communication, via a feed pipe 39 made inside the body 21 and a feed pipe 40 made inside the nozzle 23, with an injection chamber 41 of an annular shape, provided in the nozzle 23 itself and in communication with the axial hole 25.

One end of the rod 27 is set bearing upon one end 28 of a pin 29, which is able to slide in the axial hole 25 for opening/closing the holes 26. The pin 29 moreover has an opposite conical end 31 designed to engage the conical seat 24 of the nozzle 23. In greater detail, the pin 29 comprises a portion 30 guided, in a fluid-tight way, in a portion 43 of the hole 25 of the nozzle 23.

On the portion 30, towards the end 28, there acts a collar 32 guided in a cylindrical seat 49 of the body 21. The collar 32 is normally pushed towards the seat 24 by a spring 34, which contributes to keeping the holes 26 closed. The opposite end of the portion 30 terminates with a shoulder 42, on which the fuel under pressure in the chamber 41 acts.

The pin 29 has a pre-set play with respect to an internal wall of the hole 25 of the nozzle 23. This play is designed to guarantee a fast outflow of the fuel contained in the chamber 41 towards the holes 26 of the nozzle 23. Normally, the volume of the chamber 41 is smaller than the maximum amount of fuel that the electro-injector 8 has to inject. The feed pipes 39 and 40 are hence sized in such a way as to enable filling of the chamber 41 with the fuel also during the step of injection of the fuel itself into the respective combustion chamber 12.

The hollow body 21 moreover houses, in an axial end cavity 53 of its own, which communicates with the hole 35 and is set on the opposite side of the nozzle 23, a control servo-valve 44 comprising, in turn, an actuator device 45, which is coaxial with the rod 27 and is provided with an electromagnet 46. The servo-valve 44 further comprises: an anchor 47, which has a sectored configuration and is axially slidable in the hollow body 21 under the action of the electromagnet 46; and a pre-loaded spring 51, which is surrounded by the electromagnet 46 and exerts an action of thrust on the anchor 47 in a direction opposite to the attraction exerted by the electromagnet 46 itself.

The servo-valve 44 comprises a control chamber 59 made in a cylindrical tubular guide element 63, which is in turn housed in a portion of the hole 35 adjacent to the appendage 36 and inside which a piston-shaped portion 64 of the rod 27 is able to slide in a fluid-tight way.

More in particular, the chamber 59 is axially delimited between a terminal surface 66 of the portion 64 of the rod 27 and an end disk 65 housed inside the cavity 53 of the hollow body 21 in a fixed position between the actuator device 45 and the guide element 63.

The chamber 59 communicates permanently with the hole 38 for receiving fuel under pressure through a radial calibrated pipe 67 made in the guide element 63 and an annular groove 68 of the hollow body 21, which surrounds a portion of the guide element 63 itself.

The chamber 59 moreover communicates, via a calibrated pipe 69 sharing the axis A of the disk 65, with a further chamber 61, which also shares the same axis A and is made in a distribution body 70 set in an intermediate axial position between the disk 65 itself and the actuator device 45.

The body 70 comprises a base 71 axially packed tight against the disk 65, in a fluid-tight way and in a fixed position, by means of a ring-nut 56 screwed to an internal surface of the cavity 53 of the hollow body 21 and axially coupled so that it bears upon an external annular portion of the base 71 itself. The body 70 further comprises a stem or pin 50, which extends in cantilever fashion from the base 71 along the axis A in a direction opposite to the chamber 59, is delimited on the outside by a cylindrical side surface 79, and is made of a single piece with the base 71.

In detail, the chamber 61 extends through the base 71 and part of the stem 50 and communicates, on diametrally opposite sides, with respective radial holes 78 of the stem 50 itself. The holes 78 give out, in an axial position adjacent to the base 71, into an annular chamber 80 dug along the surface 79.

The chamber 80 defines, in a radially external position, an annular gap or port designed to be opened/closed by an open/close element defined by a sleeve 60 actuated by the actuator device 45 for varying the pressure in the control chamber 59 and, hence, controlling opening and closing of the holes 26 of the injection nozzle 23 by means of the axial translation of the rod 27.

The sleeve 60 is made of a single piece with the anchor 47 and has an internal cylindrical surface coupled to the surface 79 substantially in a fluid-tight way so as to slide axially between an advanced end-of-travel position and a retracted end-of-travel position.

In particular, in the advanced end-of-travel position, the sleeve 60 closes the external annular gap of the chamber 80 by being coupled so that it bears, at one 81 of its ends, upon a conical shoulder 82, which connects the surface 79 of the stem 50 to the base 71. In this position, the fuel exerts a zero resultant force of axial thrust on the sleeve 60, since the pressure in the chamber 80 acts radially on the internal cylindrical surface of the sleeve 60 itself.

In the retracted end-of-travel position, the end 81 of the sleeve 60 is set at a distance from the shoulder 82 and delimits therewith a gap for passage of the fuel towards an annular channel 83 delimited by the ring-nut 56 and by the sleeve 60 itself. The annular channel 83 communicates, through the cavity 53 of the hollow body 21, with a respective exhaust pipe 13 (illustrated in FIG. 1) so as to enable outflow of the fuel towards the tank 3.

The pressurized fuel in the chamber 59 acts on the terminal surface 66 of the portion 64 of the rod 27. Thanks to the fact that the area of the surface 66 of the rod 27 is greater than that of the shoulder 42, the pressure of the fuel, with the aid of the spring 34, normally keeps the rod 27 in a lowered position and the end 31 of the pin 29 in contact with the conical seat 24 of the nozzle 23, thus closing the injection holes 26.

In use, the fuel present in the tank 3 is taken in and precompressed by the low-pressure pump 5 and further compressed by the high-pressure pump 6 up to the pressure imposed by the control unit 20.

With particular reference to the steady running conditions of the engine 2, the fuel delivered by the pumping elements P1, P2 of the high-pressure pump 6 fills both of the delivery lines 14, both of the fractions 16 connected to the respective delivery lines 14, the outlet lines 15, which depart from each fraction 16, and the fuel-return line 17, in which the outlet lines are connected.

Furthermore, the fuel, through the respective openings 10*c* of each fraction 16, supplies the electro-injectors 8 via the respective inlet connectors 37. In particular, the fuel fills the hole 38 of the appendage 36 and from this supplies, on the one hand, the feed pipe 39 of the hollow body 21, the feed pipe 40 of the nozzle 23 and the injection chamber 41, and, on the other hand, the annular groove 68, the calibrated pipe 67, the control chamber 59 and the annular chamber 80 through the calibrated pipe 69, the chamber 61 and the holes 78.

When the control unit 20 excites the electromagnet 46 of one of the electro-injectors 8, the sleeve 60 of the anchor 47 displaces by compression the spring 51 into the retracted end-of-travel position. Consequently, the end 81 of the sleeve 60 sets itself at a distance from the shoulder 82 so as to open up a gap for passage of the fuel from the chamber 80 towards the annular channel 83 and hence towards the respective exhaust pipe 13.

The pressure of the fuel in the control chamber 59 decreases in so far as the calibrated fuel-inlet pipe 67 itself is not able to restore the flow discharged from the annular chamber 80 towards the tank 3. In turn, the pressure of the fuel in the injection chamber 41 overcomes the residual pressure on the terminal surface 66 of the rod 27 and causes displacement upwards of the pin 29 so that through the holes 26 the fuel is injected from the chamber 41 into the respective combustion chamber 12.

When the control unit 20 interrupts excitation of the electromagnet 46 of one of the electro-injectors 8, the spring 51 pushes the sleeve 60 of the anchor 47 towards the advanced end-of-travel position. Consequently, the end 81 of the sleeve 60 sets itself bearing upon the conical shoulder 82 so as to close the external annular gap of the chamber 80 and hence prevent the passage of fuel towards the respective exhaust pipe 13. The pressurized fuel entering through the connector 37 restores the pressure in the control chamber 59 so that the pin 29 re-closes the holes 26, interrupting injection into the respective combustion chamber 12.

The fuel that flows in the line 17 traverses the pressure transducer 18, which has an output connected to the control unit 20. The aforesaid control unit 20 holds in memory, as a function of the operating conditions of the engine 2, the correct values of injection pressure and the times of excitation of each control electromagnet 46 for controlling the electro-injector 8 necessary for injecting the desired amount of fuel into the individual combustion chambers 12.

In greater detail, should the pressure value indicated by the transducer 18 be higher than the correct value stored in the control unit 20, the control unit 20 itself issues a command for increase of the section of passage of the pressure regulator 19. In this way, the flow rate present in the line 17 increases, thus draining a greater amount of fuel from the fractions 16 of the storage volume 7. Consequently, the pressure prevailing in each fraction 16 and the pressure of injection into each combustion chamber 12 decrease.

In a similar way, should the pressure value indicated by the transducer 18 be lower than the correct value stored in the control unit 20, the control unit 20 itself issues a command for reduction of the section of passage of the pressure regulator 19. In this way, the flow rate present in the line 17 decreases, thus draining a smaller amount of fuel from the fractions 16 of the storage volume 7. Consequently, the pressure prevailing in each fraction 16 and the pressure of injection into each combustion chamber 12 increase.

Figure 2:
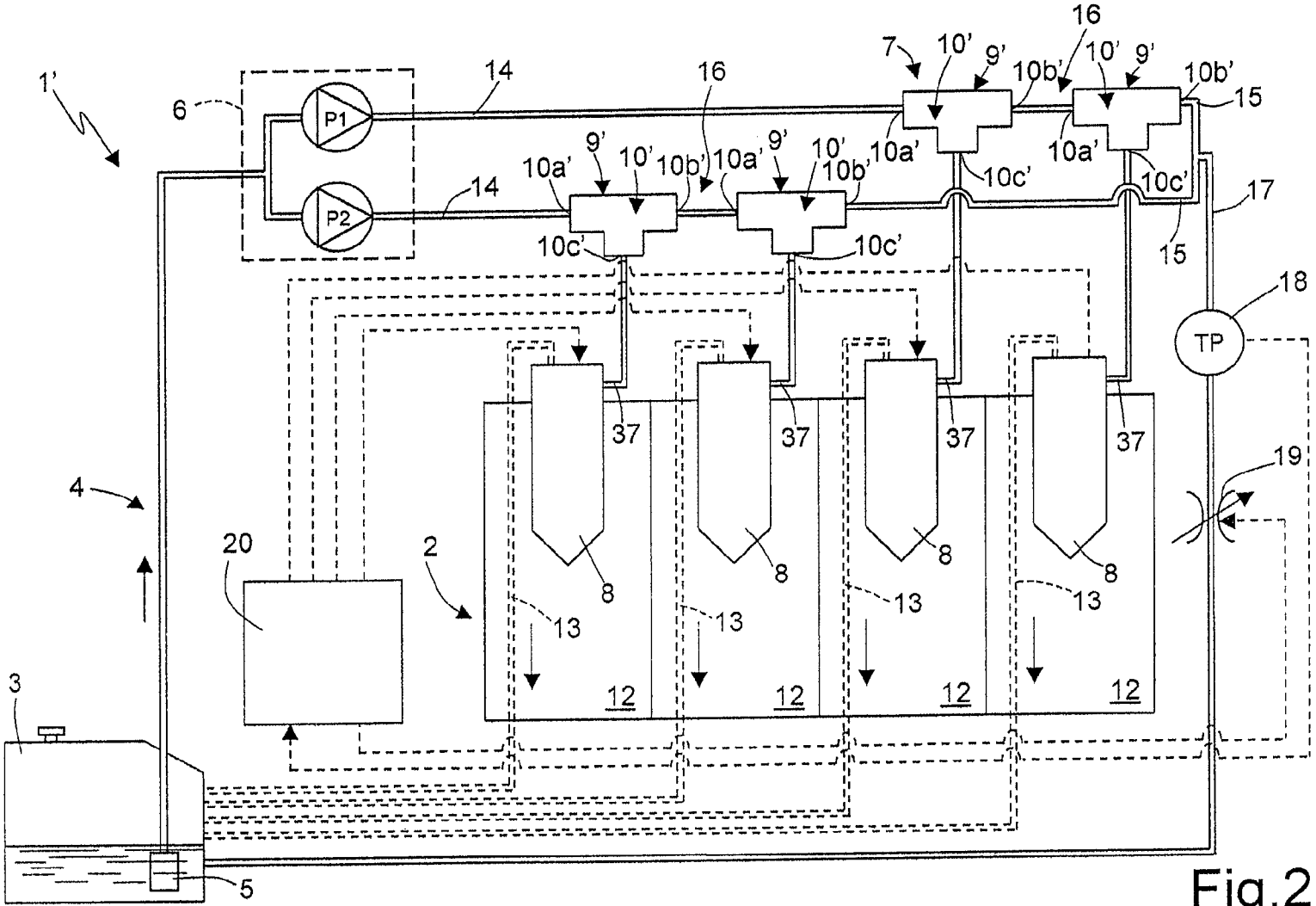
FIG. 2 is a diagram similar to that of FIG. 1 and illustrates a different embodiment of an injection system according to the present invention.

With reference to FIG. 2, designated as a whole by 1' is an injection system according to a different embodiment of the present invention. The injection system 1' is similar to the injection system 1 and will be described in what follows only as regards the aspects that differ from the latter. Corresponding or equivalent parts of the injection systems 1 and 1' will be designated, wherever possible, by the same reference numbers.

Advantageously, each fraction 16 of the storage volume 7 is further split into two distinct elementary storage volumes 9', fluidically connected together, each of which supplies a respective electro-injector 8.

In the embodiment of FIG. 1, each elementary storage volume 9' is set outside the respective electro-injector 8 and supplies it by means of a hydraulic connection that is as short as possible, for example, one having a length of less than 100 mm. Each elementary storage volume 9' can, for example, be defined by a wye 10' comprising a first through tubular portion defining, at one end, a first opening 10*a*' for intake of the fuel and, at the opposite end, a second opening 10*b*' for outlet of the fuel. Each wye body 10' moreover has a second tubular portion extending orthogonally in cantilever fashion in an intermediate position from the first tubular portion for feeding, via a third, end, opening 10*c*', the fuel into the respective electro-injector 8.

In the case in point illustrated, a first pair of elementary storage volumes 9' is set in succession on a first delivery line 14 coming out of the pumping element P1 of the high-pressure pump 6. In particular, the aforesaid pair of elementary storage volumes 9' comprises a first elementary storage volume 9' connected directly to the pumping element P1 by means the opening 10*a*' and connected, by means of its own opening 10*b*', to the opening 10*a*' of the second elementary storage volume 9'. In addition, the second elementary storage volume 9' of each of the aforesaid pair is connected to the line 15 coming out of the corresponding opening 10*b'*.

In an altogether similar way, a second pair of elementary storage volumes 9' is set in succession on a second delivery line 14 coming out of the pumping element P2 of the high-pressure pump 6.

Operation of the injection system 1' is in all respects identical to that of the injection system 1 and consequently will not be described herein.

Figure 3:
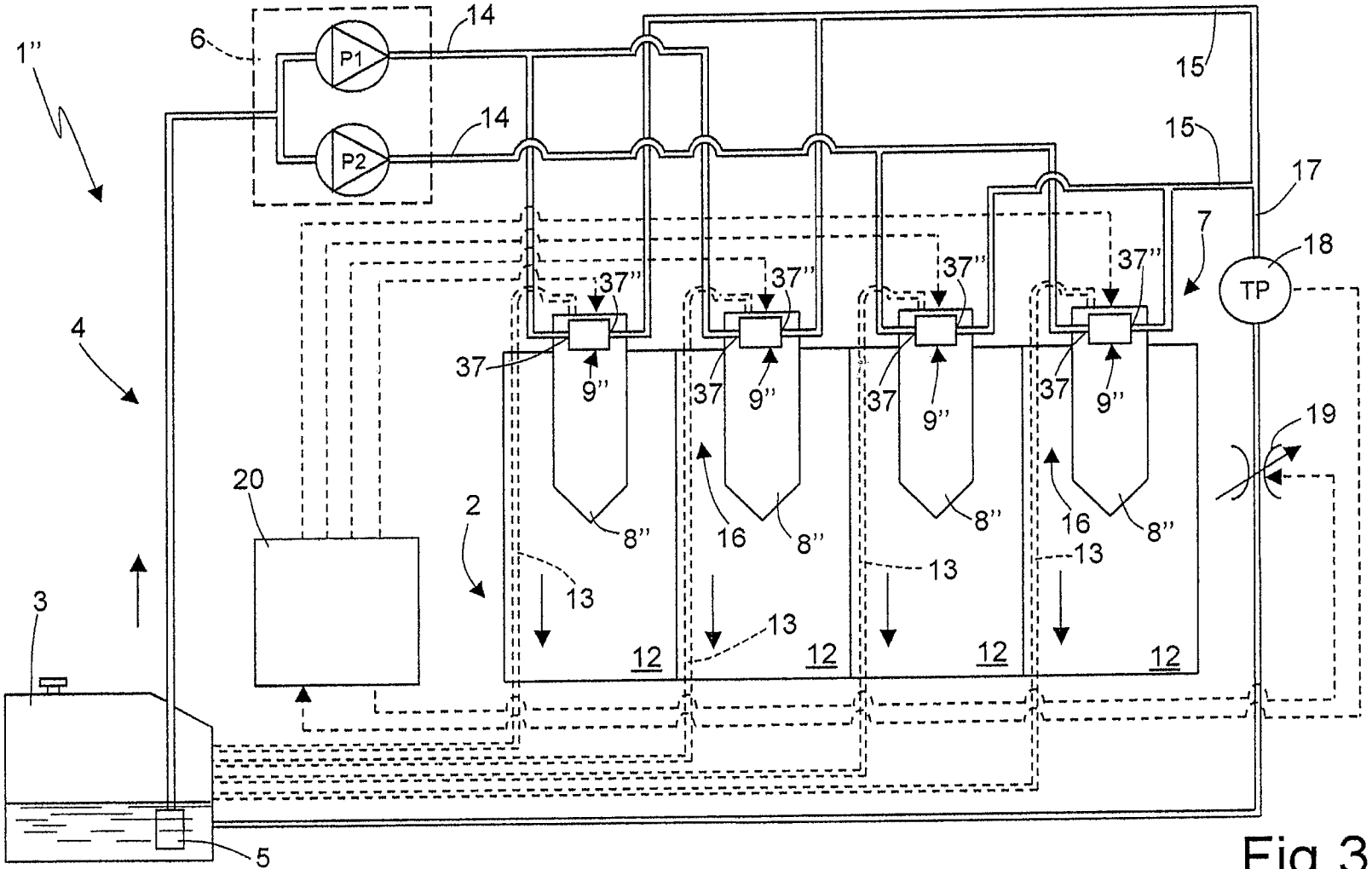
FIG. 3 is a diagram similar to that of FIG. 1 and illustrates a further embodiment of an injection system according to the present invention.

With reference to FIG. 3, designated as a whole by 1" is an injection system according to a different embodiment of the present invention. The injection system 1" is similar to the injection system 1' and will be described in what follows only as regards the aspects that differ from the latter. Corresponding or equivalent parts of the injection systems 1' and 1" will be designated wherever possible, by the same reference numbers.

In particular, the system 1" comprises an storage volume 7 advantageously divided into a plurality of elementary storage volumes 9" distinct from one another and fluidically connected, each of which is made within a respective electro-injector 8" and supplies the respective combustion chamber 12.

In the case in point illustrated (FIG. 6), each elementary storage volume 9" is obtained by:

providing, in each electro-injector 8", a pipe 39" and a pipe 40" arranged for example symmetrically on the opposite side of the axis A with respect to the pipes 39 and 40 and converging into the injection chamber 41;

creating a pair of accumulation chambers 33*a*", 33*b*" respectively in the appendage 36 and in an appendage 36" made on the hollow body 21" on the opposite side of the appendage 36 itself;

enlarging the control chamber 59; and connecting the control chamber 59 itself to the pipes 39, 40, 39", 40" and to the accumulation chambers 33*a*" and 33*b*".

In particular, the chamber 33*a*" is made along the hole 38 by enlarging as much as possible the section of passage of the fuel. The chamber 33*b*" is made in a way altogether similar along a hole 38" of the appendage 36" connected, via a connector 37", to a fluid load and to the control chamber 59. The connector 37| consequently defines a mouth for the electro-injector 8".

In greater detail, each elementary storage volume 9" is constituted by the holes 38, 38", the chambers 33*a*", 33*b*", the pipes 39, 39", 40, 40", the injection chamber 41 and the control chamber 59.

In the case in point illustrated, the inlet connectors 37 of a first pair of electro-injectors 8" are supplied by the pumping element P1 via a first delivery line 14, whilst the connectors 37" for the aforesaid first pair of electro-injectors 8" are connected to a first outlet line 15.

Likewise, the inlet connectors 37 of a second pair of electro-injectors 8" are supplied by the pumping element P2 via a second delivery line 14, whilst the connectors 37" of the aforesaid second pair of electro-injectors 8" are connected to a second outlet line 15.

The particular configuration of the electro-injectors 8" described, in combination with the location of the pressure regulator 19 downstream of the global storage volume 7, enables continuous circulation of the fuel through the electro-injectors 8" themselves and, hence, through the entire system 1".

According to a possible alternative (not illustrated), the chamber 33*b*" and the pipes 39", 40" could be connected just to the injection chamber 41 and not to the control chamber 59.

Operation of the injection system 1" is in all respects identical to that of the injection system 1 and consequently will not be described herein.

According to yet a further possibility (not illustrated), each fraction 16 of the storage volume 7 could be further split into a first series of elementary storage volumes set within respective electro-injectors and a second series of elementary storage volumes set outside said electro-injectors. In practice, the storage volume corresponding to each electro-injector is made partly on the inside and partly on the outside.

Figure 6:
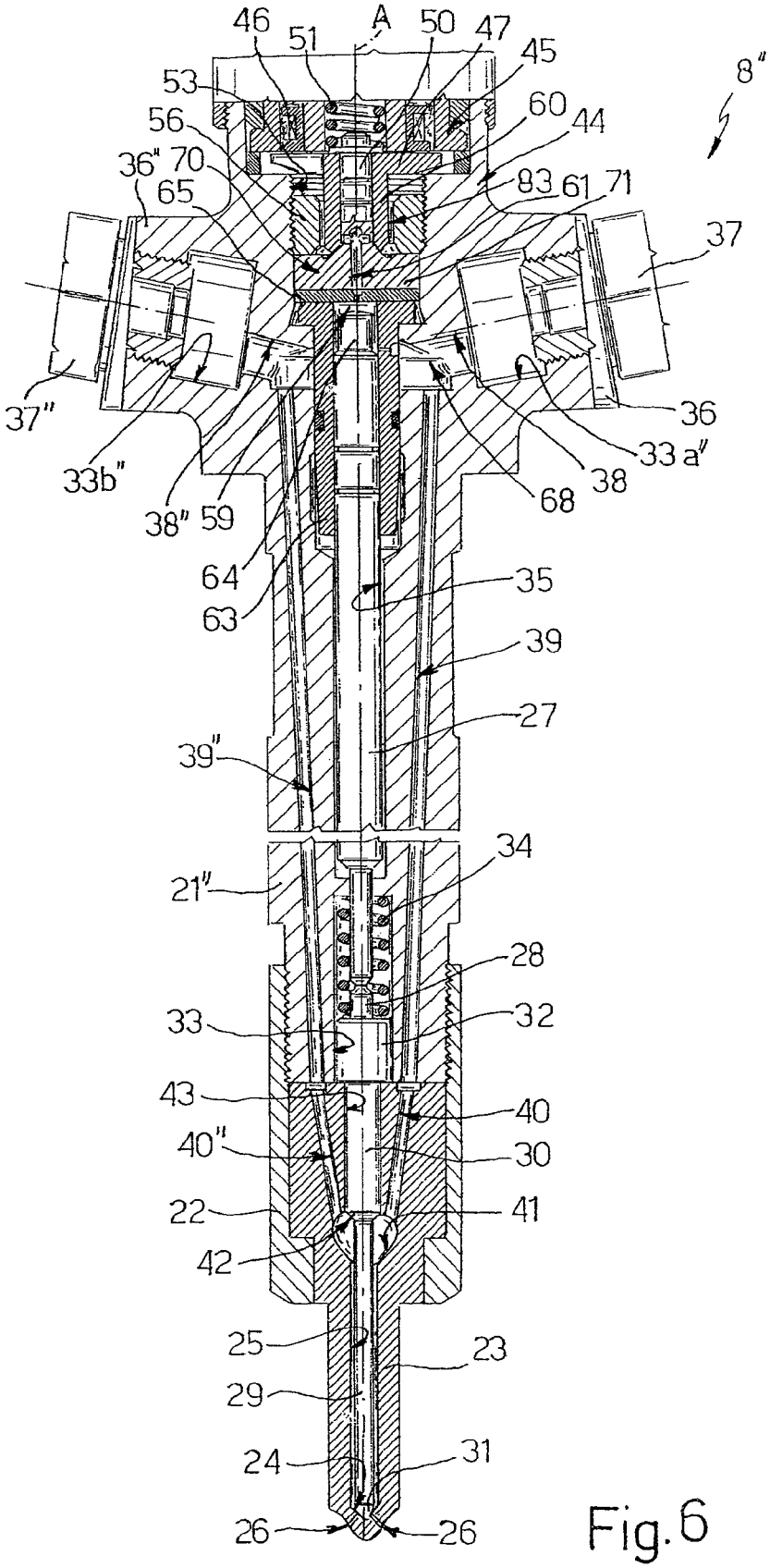
FIG. 6 is a cross-sectional view, at an enlarged scale, of an injector of the systems illustrated in FIGS. 2 and 3.

The modalities of creation of the elementary storage volume inside each electro-injector may vary widely, it remaining understood that what is illustrated in FIG. 6 constitutes just one possible example. In particular, the pipes 39", 40" and the additional connector 36" could even be omitted, or again the pipes 39", 40" could in any case be made through the hollow body 21 without any need to associate them to the additional connector 36" but by simply connecting them between the injection chamber 41 and the control chamber 59. According to a further possible alternative, it would also be possible to provide the additional connector 36" connecting it exclusively to the control chamber 59, but without providing the pipes 39" and 40".

From an examination of the characteristics of the injection systems 1, 1', 1" made according to the present invention, the advantages that this enables are evident.

In particular, thanks to the splitting of the storage volume 7 into a plurality of fractions 16 that are distinct and fluidically connected, it is possible to improve the operation of the engine 2 and contain the pollutant emissions during the starting transient and during the steady running conditions.

With particular reference to the system 1, during the starting transient, the fractions 16 are rapidly filled by the fuel, in so far as they globally have a smaller capacity than the storage volume normally employed, and rapidly reach the correct injection pressure. Consequently, at the moment of starting of the engine 2, the injection of fuel by the injectors 8 into the combustion chambers 12 takes place in correct conditions, so improving the efficiency of the engine 2 and reducing the emission of pollutant substances at the exhaust.

Furthermore, the fractions 16, which are characterized by particularly small overall dimensions, can be more easily positioned inside the system 1.

With particular reference to the systems 1', 1", further splitting of the fraction 16 into elementary storage volumes 9', 9" renders even more effective operation of the engine 2 and reduces even further the emission of pollutant substances in the exhaust.

In addition, with reference to the systems 1, 1', 1", in the steady-state conditions of the engine 2, the fractions 16, which, in the systems 1', 1" are further split into the elementary storage volumes 9', 9", albeit of reduced capacity, enable dampening of the pressure oscillations induced by opening of the electro-injectors 8, 8' inside the fractions 16 themselves, on account of the small distance of said storage volumes 9', 9" from the holes 26. In this way, operation of the engine 2 is correct, and the emission of pollutant substances in the exhaust remains contained.

Finally, it is clear that modifications and variations may be made to the injection systems 1, 1', 1" described and illustrated herein, without thereby departing from the sphere of protection of the ensuing claims.

The invention claimed is:

1. A fuel-injection system for an internal-combustion engine comprising:

a tank for said fuel;

compressor assembly for making available said fuel at a high pressure;

a plurality of injectors including respective elementary storage volumes adapted to receive said fuel at a high pressure from said respective storage volumes, said injectors injecting said fuel into respective combustion chambers of said engine;

a return line for connecting said elementary storage volumes to said tank, wherein said compressor means generate at least two distinct delivery lines which supply respective distinct fractions of said storage volume, and wherein each of said injectors comprises: an inlet section for supply of the fuel; an outlet section for outlet of said fuel towards the respective combustion chamber of the engine; an exhaust section of said fuel towards a collection tank; and a further section for a load, which is fluidically connected to said inlet section through the corresponding said elementary storage volume.

2. The system according to claim 1, wherein each of said elementary storage volumes comprises: an inlet section supplied with said fuel; a first outlet section for making available said fuel to the corresponding injector; and a second outlet section for supplying a load with said fuel.

3. The system according to claim 1, wherein said inlet section of each of said injectors is supplied by a respective delivery tine of said compressor means, and wherein said sections for said injectors are fluidically connected to one another.

4. The system according to claim 1, further comprising: pressure-regulating means for regulating the pressure in said storage volumes, fluidically set in series to said return line; wherein said regulating means are fluidically set downstream of said storage volume so as to enable a continuous flow of fuel through said storage volume.

5. The system according to claim 1, wherein said compressor assembly comprise a high-pressure pump having at least two pumping elements which are operable for raising the pressure of said fuel, said pumping elements generating pressure respective in said delivery lines.

6. The system according to claim 1, wherein the compressor assembly comprises a low-pressure pump immersed in the fuel contained in the tank, and a high-pressure pump which supplies the storage volumes directly and, hence, the injectors.

7. A fuel-injection system, for an internal-combustion engine comprising:

a tank for said fuel;

compressor assembly for making available said fuel at a high pressure;

a plurality of injectors including respective elementary storage volumes adapted to receive said fuel at a high pressure from said respective storage volumes, said injectors injecting said fuel into respective combustion chambers of said engine;

a return line for connecting said elementary storage volumes to said tank, wherein said compressor means generate at least two distinct delivery lines which supply respective distinct fractions of said storage volume, and wherein each elementary storage volume comprises a first pipe fluidly connected to a second pipe converging into an injection chamber.

8. The system according to claim 7, wherein each elementary storage volume further comprises at least one accumulation chamber fluidly connected to said first and second pipes.

9. The system according to claim 8, wherein each elementary storage volume further comprises an enlarged control chamber interposed between said accumulation chamber and said first and second pipes.

10. The system according to claim 7, wherein each of said elementary storage volumes comprises: an inlet section supplied with said fuel; a first outlet section for making available said fuel to the corresponding injector; and a second outlet section for supplying a load with said fuel.

11. The system according to claim 7, further comprising: -pressure-regulating means for regulating the pressure in said storage volumes, fluidically set in series to said return line; wherein said regulating means are fluidically set downstream of said storage volume so as to enable a continuous flow of fuel through said storage volume.

12. The system according to claim 7, wherein said compressor assembly comprise a high-pressure pump having at least two pumping elements which are operable for raising the pressure of said fuel, said pumping elements generating pressure respective in said delivery lines.

13. The system according to claim 12, wherein the compressor assembly comprises a low-pressure pump immersed in the fuel contained in the tank, and a high-pressure pump which supplies the storage volumes directly and, hence, the injectors.

* * * * *